US005757331A

United States Patent [19]

Yoneyama et al.

[11] Patent Number: 5,757,331

[45] Date of Patent: May 26, 1998

[54] LEAKAGE DIELECTRIC WAVEGUIDE AND PLANE ANTENNA USING SAID LEAKAGE DIELECTRIC WAVEGUIDE

[75] Inventors: Tsukasa Yoneyama, Sendai; Youhei Ishikawa; Tohru Tanizaki, both of Kyoto, all of Japan

[73] Assignee: Murata Manufacturing Co., Ltd., Japan

[21] Appl. No.: 583,854

[22] Filed: Jan. 11, 1996

Related U.S. Application Data

[63] Continuation of Ser. No. 213,250, Mar. 14, 1994, abandoned.

[30] Foreign Application Priority Data

Mar. 12, 1993 [JP] Japan ..... 5-052014

[51] Int. Cl.[6] ..... H01Q 13/20; H01P 3/20

[52] U.S. Cl. ..... 343/783; 343/784; 343/785; 343/771; 333/237; 333/248; 333/239

[58] Field of Search ..... 343/770, 771, 343/783, 784, 785, 753, 755; 333/239, 240, 248, 237

[56] References Cited

U.S. PATENT DOCUMENTS

| | | | |
|---|---|---|---|
| 2,433,368 | 12/1947 | Johnson et al. | 333/237 X |
| 2,596,190 | 5/1952 | Wiley | 343/783 |
| 3,015,100 | 12/1961 | Rotman | 333/239 X |
| 3,233,242 | 2/1966 | Voronoff | 343/785 X |
| 4,463,330 | 7/1984 | Yoneyama | 333/239 |
| 4,916,458 | 4/1990 | Goto | 343/770 X |
| 5,416,492 | 5/1995 | Takahashi et al. | 343/771 |

FOREIGN PATENT DOCUMENTS

| | | | |
|---|---|---|---|
| 57-48804 | 3/1982 | Japan | 343/770 |

OTHER PUBLICATIONS

Conference Proceedings 20th European Microwave Conference 90, vol. 1, Sep. 1990, pp. 95–104, "A New Class of Scannable Millimeter–Wave Antennas" by Arthur A. Oliner.

Electronics and Communications in Japan, Part II: Electronics, No. 2, Feb. 1991; pp. 20–28, "Millimeter–Wave Integrated Circuits Using Nonradiative Dielectric Waveguide" by Tsukasa Yoneyama.

(List continued on next page.)

*Primary Examiner*—Benny T. Lee

*Attorney, Agent, or Firm*—Ostrolenk, Faber, Gerb & Soffen, LLP

[57] ABSTRACT

A leakage dielectric waveguide includes a housing made of plane-shaped electrical conductors located parallel to each other, and a dielectric strip for propagating a high-frequency wave between the parallel electrical conductors, wherein the dielectric strip is provided within the housing. The housing is arranged to be asymmetrical, thereby leaking and radiating a high-frequency wave propagating through the dielectric strip. The housing is preferably further composed of the plane-shaped parallel electrical conductors and a side wall. A plane antenna includes the above-mentioned leakage dielectric waveguide, and a projecting device for projecting the high-frequency wave toward a free space in response to a high-frequency wave being projected from the dielectric waveguide. Alternately, a plane antenna includes a plurality of the above-mentioned leakage dielectric waveguides, and a projecting device for projecting either one high-frequency wave or a plurality of high-frequency waves toward a free space in response to a plurality of high-frequency waves being projected from the plurality of dielectric waveguides.

12 Claims, 13 Drawing Sheets

OTHER PUBLICATIONS

1987 International Symposium Digest Antennas and Propagation, vol. I, Jun. 1987, pp. 372, 375, "Planar Slot Array Fed by Coupled Dielectric Lines in a Metal Waveguide", by J.A.G. Malherbe et al.

Tsukasa Yoneyama et al., "Leaky-wave NRD-guide With Broadside Radiation", The Proceeding of Spring Meeting of the Institute of Electronics, Information and Communications Engineers, in Japan, B-43, pp. 2-43, Mar. 1992 (Partial English translation attached).

Yoshihiko Wagatsuma et al., "Preliminary Experiments of Leaky-wave NRD-guide Fed Planar Antenna", The Proceeding of Spring Meeting of the Institute of Electronics, Information and Communications Engineers, in Japan, B-44, pp. 2-44, Mar. 1991 (Partial English translation attached).

Reindel, John; "The H-Guide -A Useful Waveguide for Millimeter Waves"; *Technical Memorandum, Electronic Defense Laboratories*; EDL-M377; 11 Aug. 1961; pp. 1-6, 11.21-23.30.

LEAKAGE DIELECTRIC WAVEGUIDE AND PLANE ANTENNA USING SAID LEAKAGE DIELECTRIC WAVEGUIDE

RELATED APPLICATION

This is a continuation of application Ser. No. 08/213,250 filed on Mar. 14, 1994, now abandoned.

BACKGROUND OF THE INVENTION

1. Field of the Invention

The present invention relates to a leakage dielectric waveguide and a plane antenna using the leakage dielectric waveguide, and particularly, to a leakage dielectric waveguide for leaking and radiating a high-frequency wave and a plane antenna using the leakage dielectric waveguide. In the specification, the term "high-frequency waves" means microwaves, quasi-millimeter waves, or millimeter waves which have a frequency higher than approximately 1 GHz.

2. Description of the Prior Art

As a dielectric waveguide for millimeter wave integrated circuits, there has been conventionally known to those skilled in the art, a nonradiative dielectric waveguide (hereinafter, referred to as an NRD waveguide), in which a dielectric strip is sandwiched between upper and lower metal plates. The conventional NRD waveguide is disclosed in, for example, Japanese Patent Examined Publication No. 1-51202. In the NRD waveguide, there has been proposed a leakage NRD waveguide (hereinafter, referred to as a conventional leakage NRD waveguide), in which the dielectric strip is provided with a plurality of recessed portions at intervals of a propagation wavelength of electromagnetic waves λg. In this case, a millimeter wave signal is applied to an end of the NRD waveguide for excitation, and then the millimeter wave signal is leaked between the upper and lower metal plates so that radiation is accomplished. The conventional NRD waveguide is disclosed in, for example, Tsukasa Yoneyama et al., "Leakage Wave NRD waveguide of Broadside Radiation", the Proceedings of Spring Meeting of the Institute of the Electronics, Information, and Communications Engineers, in Japan, as published on Mar. 15, 1992.

Further, there is also proposed a plane antenna, in which the conventional leakage NRD waveguide and a slot antenna are combined with each other. This is disclosed in, for example, Toshihiko Agatsuma et al., "Preliminary Experiments on Plane Antenna with Transmission Lines of Leakage Wave NRD waveguides", the Proceedings of Spring Meeting of the Institute of the Electronics, Information, and Communications Engineers, in Japan, as published on Mar. 15, 1992.

However, in order to provide the recessed portions in the dielectric strip, it is necessary to perform an extremely complex manufacturing process. This results in expensive manufacturing cost.

Further, reflected waves may be generated in a plurality of recessed portions formed in the dielectric strip. This leads to difficulty in achieving successful impedance matching. In addition, this causes deterioration in the frequency characteristic of input impedance, and results in a narrower usable bandwidth depending on the number of the recessed portions.

Accordingly, the plane antenna, comprising both of the conventional leakage NRD waveguide and a slot antenna which are combined with each other, has a relatively narrow operating bandwidth and a relatively low radiation efficiency, disadvantageously.

SUMMARY OF THE INVENTION

An object of the present invention is therefore to provide a leakage dielectric waveguide capable of being manufactured using a manufacturing process that is simpler and less expensive than the conventional manufacturing process. It is another object of the present invention to provide a leakage dielectric waveguide that is capable of operating over a wider bandwidth and projecting radio waves with a radiation efficiency higher than those of the conventional devices.

Another object of the present invention is to provide a plane antenna using the above-mentioned leakage dielectric waveguide, capable of being manufactured using a manufacturing process that is simpler and less expensive than the conventional manufacturing process, and capable of operating over a wider bandwidth and projecting radio waves with a radiation efficiency higher than those of the conventional devices.

In order to achieve the aforementioned objectives, according to one aspect of the present invention, there is provided a leakage dielectric waveguide comprising:

a housing made of plane-shaped parallel electrical conductors provided so as to be parallel to each other; and a dielectric strip for propagating a high-frequency wave between the parallel electrical conductors, the dielectric strip being provided within the housing;

wherein the housing is formed to be vertically asymmetrical, thereby leaking and radiating the high-frequency wave propagating through said dielectric strip.

Further, according to another aspect of the present invention, there is provided a leakage dielectric waveguide comprising:

upper and lower parallel electrical conductors provided so as to be parallel to each other;

a dielectric strip for propagating a high-frequency wave between the parallel electrical conductors, the dielectric strip being provided between the upper and lower parallel electrical conductors: and a vertically asymmetrical housing for leaking and radiating the high-frequency wave propagating through the dielectric strip, the housing being provided on one or both sides of the dielectric strip.

In the above-mentioned leakage dielectric waveguide, the asymmetrical housing preferably includes a step formed in the housing.

In the above-mentioned leakage dielectric waveguide, the asymmetrical housing preferably includes a further dielectric strip which is formed on the housing so as to be separate from the dielectric strip and so that the longitudinal direction of the dielectric strip is parallel to that of the further dielectric strip.

In the above-mentioned leakage dielectric waveguide, the asymmetrical housing preferably includes a microstrip line which is formed on the housing so as to be separate from the dielectric strip and so that a longitudinal direction of the dielectric strip is parallel to that of the microstrip line.

In the above-mentioned leakage dielectric waveguide, the asymmetrical housing preferably includes a projecting electrical conductor which is formed on the housing so as to vertically project into the inner part of the housing.

In the above-mentioned leakage dielectric waveguide, the asymmetrical housing preferably includes a dielectric slab formed on the housing so as to be separate from the dielectric strip and so that the longitudinal direction of the dielectric slab is perpendicular to that of the dielectric strip.

In the above-mentioned leakage dielectric waveguide, the asymmetrical housing preferably includes a plurality of dielectric slabs which are formed parallel to each other at intervals of a propagation wavelength of the high-frequency wave on one inner surface of the housing so as to be separate from the dielectric strip and so that the longitudinal direction of the dielectric slabs is perpendicular to that of the dielectric strip.

In the above-mentioned leakage dielectric waveguide, the asymmetrical housing preferably includes a plurality of first dielectric slabs and a plurality of second dielectric slabs, wherein the plurality of first dielectric slabs are formed parallel to each other at intervals of a propagation wavelength of the high-frequency wave, on one inner surface of the housing so as to be separate from the dielectric strip and so that the longitudinal direction of the first dielectric slabs is perpendicular to that of the dielectric strip, and wherein the plurality of second dielectric slabs are formed parallel to each other at intervals of a propagation wavelength of the high-frequency wave and at a central position in the horizontal direction of the plurality of first dielectric slabs, on another inner surface of the housing so as to be separate from the dielectric strip and so that the longitudinal direction of the second dielectric slabs is perpendicular to that of the dielectric strip.

In the above-mentioned leakage dielectric waveguide, the housing further preferably comprises a side wall.

According to a further aspect of the present invention, the leakage dielectric waveguide further comprises deflection means for deflecting a direction of radiation of the leaked and radiated high-frequency wave toward a predetermined direction.

According to a still further aspect of the present invention, in the above-mentioned leakage dielectric waveguide, the housing preferably includes deflection means for deflecting a direction of radiation of the leaked and radiated high-frequency wave toward a predetermined direction.

In the above-mentioned leakage dielectric waveguide, the deflection means is preferably a dielectric prism.

In the above-mentioned leakage dielectric waveguide, the dielectric strip and the housing are preferably arranged so that the leaked and radiated high-frequency wave is radiated toward a predetermined direction of radiation.

According to a further aspect of the present invention, there is provided a plane antenna comprising:

the above-mentioned leakage dielectric waveguide; and projecting means in response to the high-frequency wave being projected from the dielectric waveguide; for projecting the high-frequency wave toward free space in response to a plurality of high-frequency waves being projected from the plurality of dielectric waveguides;

According to a still further aspect of the present invention, there is provided a plane antenna comprising:

a plurality of the above-mentioned leakage dielectric waveguides; and projecting means for projecting either one high-frequency wave or a plurality of high-frequency waves toward a free space in response to a plurality of high-frequency waves being projected from the plurality of dielectric waveguides;

As described above in detail, according to the present invention, there are provided the following:

(a) a leakage dielectric waveguide having a dielectric strip provided within a housing composed of plane-shaped parallel electrical conductors, wherein the housing is arranged to be asymmetrical so that a high-frequency wave that propagates through the dielectric strip is leaked and radiated;

(b) a dielectric waveguide having a dielectric strip provided within a housing composed of plane-shaped parallel electrical conductors and side walls, wherein the housing is arranged to be asymmetrical so that a high-frequency wave that propagates through the dielectric strip is leaked and radiated; and (c) a dielectric waveguide having a dielectric strip sandwiched between upper and lower parallel electrical conductors, wherein a vertically asymmetrical housing for leaking and radiating a high-frequency wave that propagates through the dielectric strip is provided on both sides or one side of the dielectric strip.

Accordingly, the dielectric strip is not provided with recessed portions unlike the conventional device, but is provided with only an asymmetrical housing. As a result, the manufacturing process becomes simple and the manufacturing cost can be reduced. Besides, since the dielectric strip is not provided with a plurality of recessed portions, unnecessary waves can be suppressed, so that frequency characteristic of input impedance can be improved and wider-bandwidth operation can be realized.

Further, according to the present invention, there is provided a leakage dielectric waveguide further comprising deflection means for deflecting the direction of radiation of a leaked and radiated high-frequency wave toward a predetermined direction, wherein the housing includes deflection means for deflecting the direction of radiation of a leaked and radiated high-frequency wave toward a predetermined direction or wherein the dielectric strip and the housing are arranged so that the leaked and radiated high-frequency wave is radiated toward a predetermined direction. With this arrangement, the radiated high-frequency wave can be deflected toward the same direction so as to be radiated with high radiation efficiency in a state of a substantially uniform electric field distribution and almost no residual power.

Still further, according to the present invention, there are provided plane antennas in which the above-mentioned leakage dielectric waveguide is combined with means for radiating a leaked and radiated high-frequency wave into free space. In this arrangement, a plane antenna which operates in a wider bandwidth and with higher efficiency can be implemented, compared with the conventional plane antenna.

BRIEF DESCRIPTION OF THE DRAWINGS

These and other objects and features of the present invention will become clear from the following description taken in conjunction with the preferred embodiments thereof with reference to the accompanying drawings throughout which like parts are designated by like reference numerals, and in which.

DETAILED DESCRIPTION OF THE PREFERRED EMBODIMENTS

Preferred embodiments according to the present invention are described hereinbelow with reference to the accompanying drawings.

Figure 8:
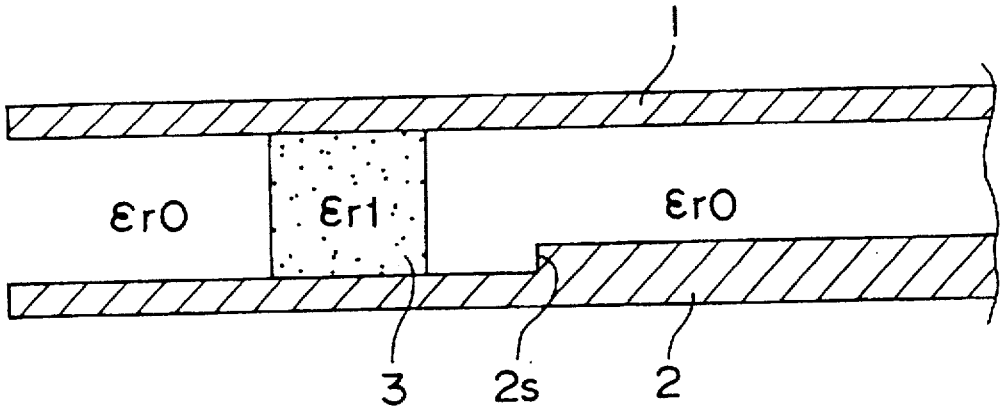
FIG. 8 is a longitudinal sectional view of a leakage NRD waveguide, which is a third modification of the first preferred embodiment according to the present invention.

Generally, homogeneous NRD waveguides are the dielectric waveguides which do not effect radiation in the hybrid transmission mode, however, the preferred embodiments according to the present invention have the following features. Referring to FIG. 8, in an NRD waveguide having a dielectric strip 3 sandwiched between upper and lower electrical conductor plates 1 and 2, for example, a step 2*s* is formed in the lower electrical conductor plate 2, at portions on the left or right side or both sides of the dielectric strip 3 in a direction perpendicular to the longitudinal direction of the dielectric strip 3, so that the vertical symmetry of the waveguide housing structure is disrupted, i.e. a vertically asymmetrical housing is provided. This disruption causes a leakage high-frequency wave which corresponds to a high-frequency signal transmitted in the NRD waveguide to be leaked from the NRD waveguide and to be radiated in a direction which is not parallel to the longitudinal direction of the NRD waveguide; Hereinafter, an NRD waveguide which leaks and radiates a leakage high-frequency wave as a result of a discontinuity in the surrounding environment which causes leakage from the NRD waveguide is referred to as a leakage NRD waveguide.

<First preferred embodiment>

Figure 1:
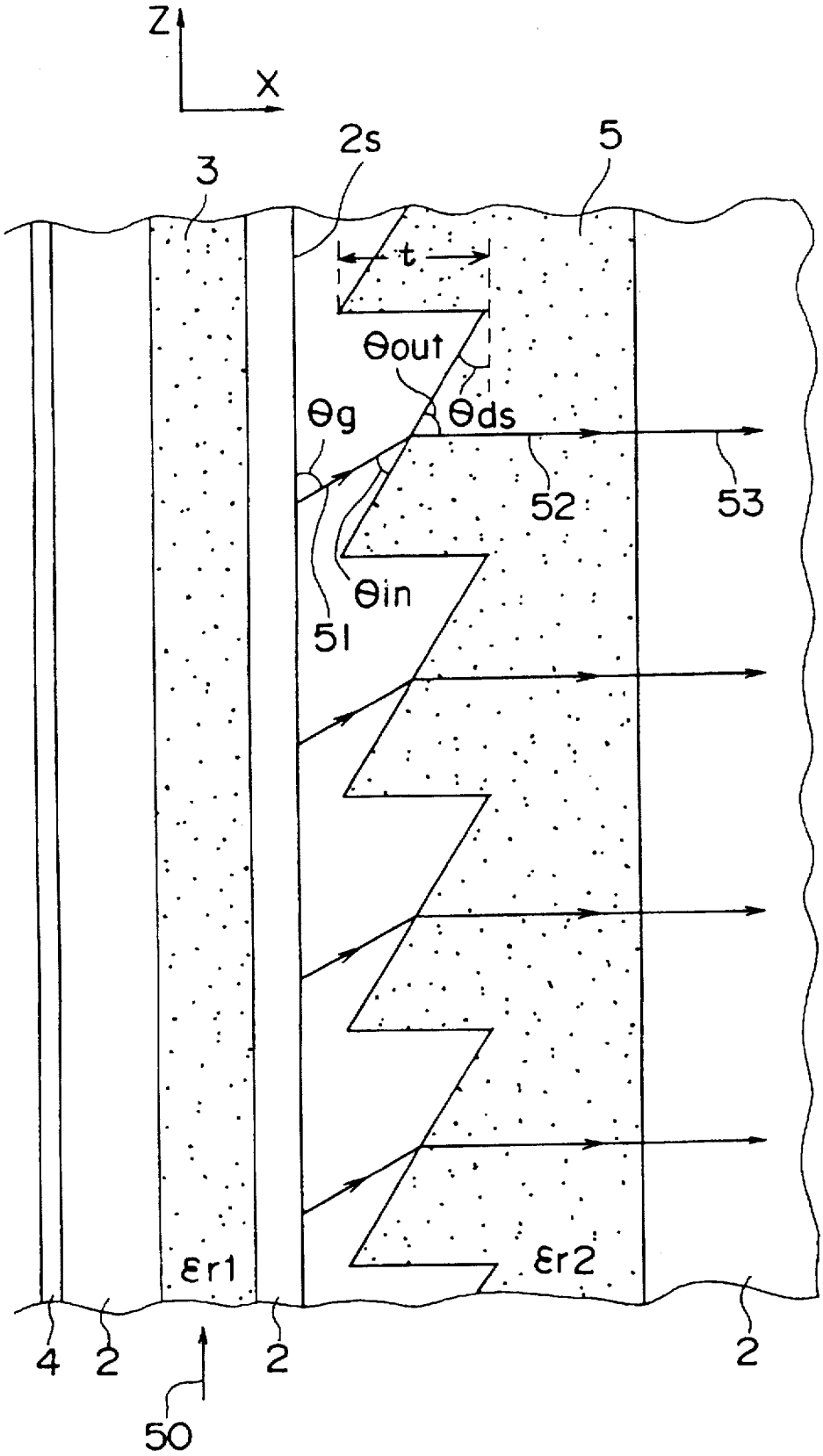
FIG. 1 is a plan view of a plane antenna apparatus using a leakage NRD waveguide, which is a first preferred embodiment according to the present invention.
Figure 2:
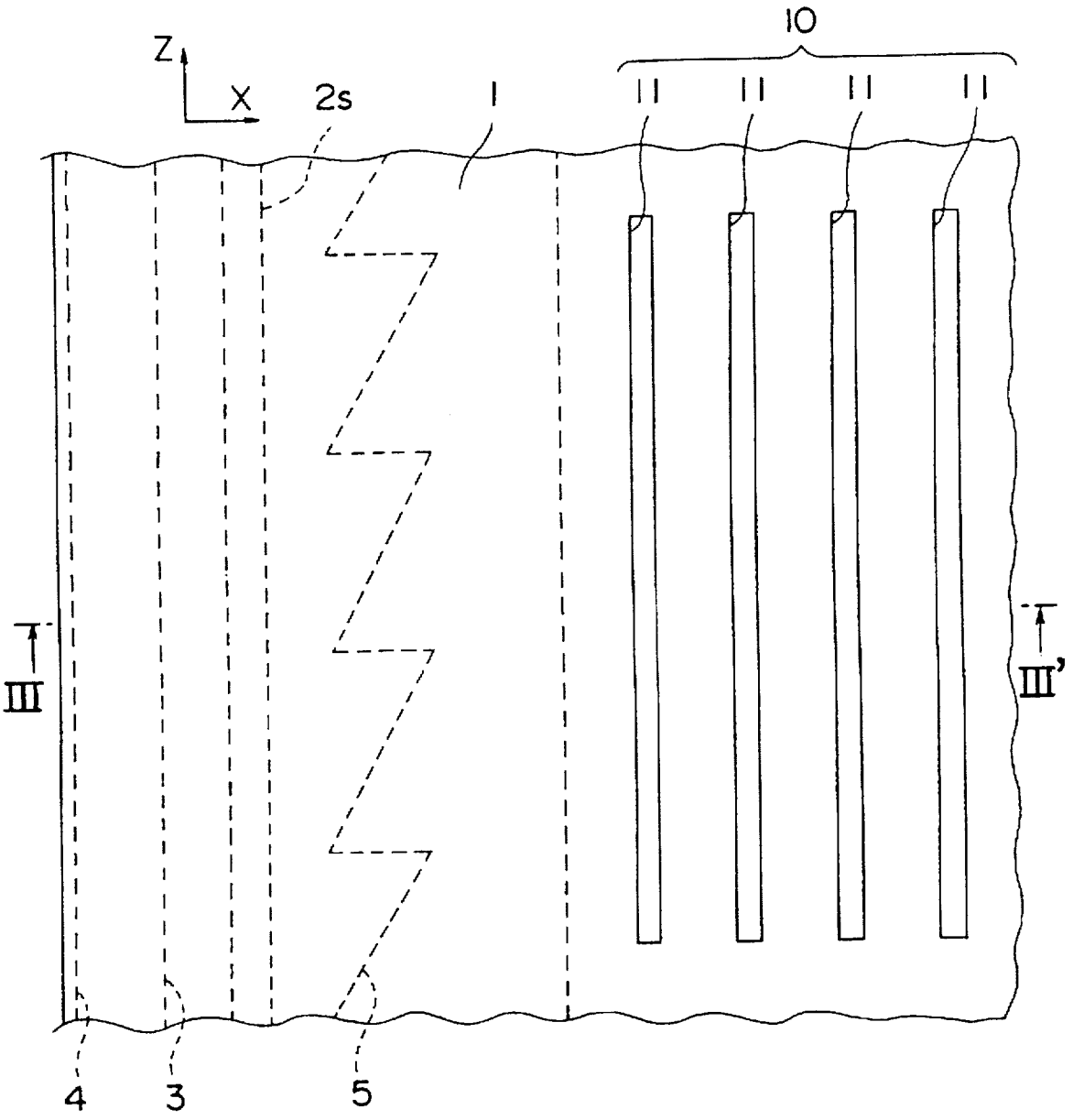
FIG. 2 is a plan view of the plane antenna apparatus of FIG. 1.
Figure 3:
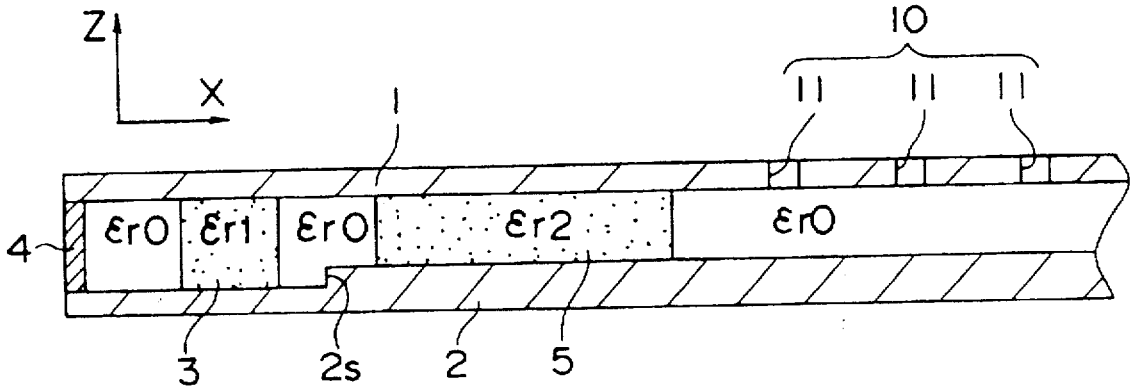
FIG. 3 is a longitudinal sectional view taken along a line III—III' of FIG. 2.

FIG. 1 is a plan view of a plane antenna apparatus using a leakage NRD waveguide which is a first preferred embodiment according to the present invention, in which the electrical conductor plate 1 has been removed. FIG. 2 is a plan view of the plane antenna apparatus of FIG. 1. FIG. 3 is a longitudinal sectional view taken along a line III—III' of FIG. 2. In these figures, the longitudinal direction of the dielectric strip 3 of the NRD waveguide is taken as the Z-axis direction, the direction perpendicular to the Z-axis direction in the plan view of FIG. 1 is taken as the X-axis direction, and the direction perpendicular to both the Z-axis direction and X-axis direction is taken as the Y-axis direction.

The plane antenna apparatus using the leakage NRD waveguide of the first preferred embodiment, as shown in FIGS. 1 through 3, comprises a leakage NRD waveguide and a slot antenna 10 shown in FIGS. 2 and 3. The leakage NRD waveguide includes the dielectric strip 3, the step 2*s* and the dielectric prism 5. The step 2*s* creates a discontinuity which causes a high-frequency wave propagating through the dielectric strip 3 (itself an NRD waveguide) to leak a portion of the high-frequency wave toward the general direction of the step 2*s*. The step 2*s*; is formed in the electrical conductor plate 2 at a position which is a predetermined distance away from the dielectric strip 3 and at which position the strength of electric field generated by a high-frequency signal transmitted by the dielectric strip 3 is relatively high. The step 2*s* includes a surface that is parallel to the longitudinal direction of the dielectric strip 3 which is the Z-axis direction. As described below, the leaked waves radiate from the dielectric strip 3 in a direction which form an angle $\theta g$ with the longitudinal direction (the Z direction) of dielectric strip 3. In the described embodiment, it is desirable to cause these waves to propagate in a direction perpendicular to the longitudinal direction of the dielectric strip 3. To this end, a dielectric prism 5 is provided for deflecting the direction of radiation of the leakage high-frequency wave in a direction perpendicular to the longitudinal direction of the dielectric strip 3. The dielectric prism is located at a position which is spaced away from the dielectric strip 3 and located so that the step 2*s* is located between the dielectric strip 3 and the dielectric prism 5.

As shown in FIG. 3, the dielectric strip 3 is sandwiched between the upper and lower plane-shaped electrical conductor plates 1 and 2 which are parallel to each other. At an edge portion of the electrical conductor plates 1 and 2 and spaced a predetermined distance away from the dielectric strip 3 in a direction perpendicular to the longitudinal direction of the dielectric strip 3 as seen in FIG. 3, a reflection plate 4 made of a metal electrical conductor plate is provided. The reflection plate 4 is located at a left hand edge portion of the plates 1 and 2 as seen in FIG. 3. The reflection plate 4 is disposed to be substantially parallel to the dielectric strip 3 and located in a leftward direction relative to the dielectric strip 3 as seen in FIG. 3. The above-mentioned leftward direction is the negative direction of X-axis, and hereinafter, the leftward direction is referred to as a direction leftward from the dielectric strip 3 in the plan views or sectional views, while the rightward direction is referred to as a direction rightward from the dielectric strip 3 in the plan views or sectional views. Meanwhile, a single staircase-like step 2*s* is provided in the electrical conductor plate 2 at a position which is a predetermined distance away from the dielectric strip 3 in a direction perpendicular to the longitudinal direction of the dielectric strip 3. The single step 2*s* is disposed in the rightward direction and is parallel to the longitudinal direction of the dielectric strip 3. The step 2*s* is formed so as to rise in a direction perpendicular to the plane of the electrical conductor plate 2 and to reduce the distance between the upper and lower electrical conductor plates 1 and 2. The distance between the electrical conductor plates 1 and 2 maintained at all positions along a rightward direction relative to the step 2*s*.

Figure 6:
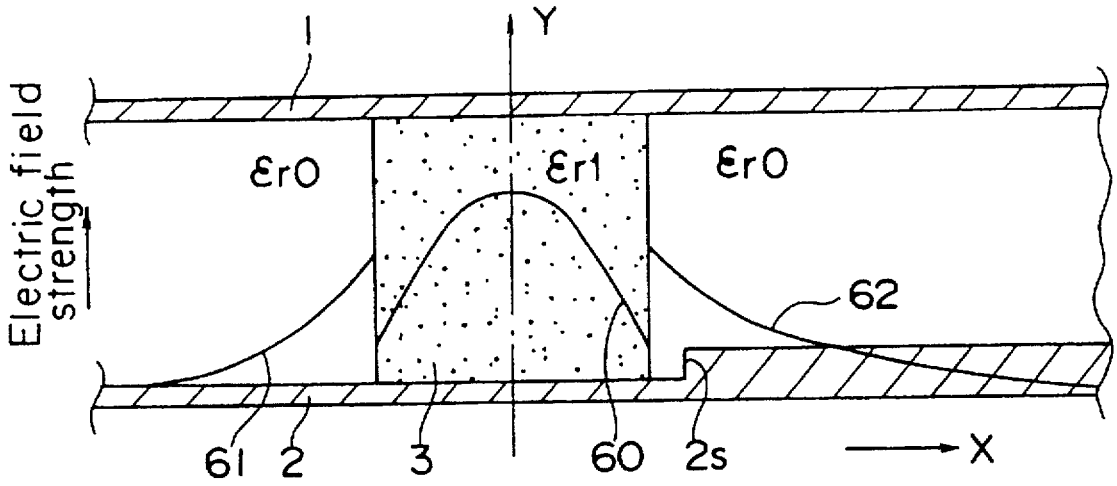
FIG. 6 is a longitudinal sectional view showing electric field strength in proximity to the leakage NRD waveguide, which is provided for explaining an operation of leakage radiation in the leakage NRD waveguide of the first preferred embodiment.

When a high-frequency signal is fed to the dielectric strip 3 in the direction indicated by an arrow 50 shown in FIG. 1 which is the Z-axis direction, the high-frequency signal propagates through the dielectric strip 3 in the Z-axis direction. In this case, the distribution of electric field strength in the dielectric strip 3 and in the vicinity thereof is as shown in FIG. 6. Reference numeral 60 in FIG. 6 identifies an electric field strength within the dielectric strip 3 having a dielectric constant $\epsilon_{r1}$. Reference numeral 61 in FIG. 6 identifies an electric field strength of an air space having a dielectric constant $\epsilon_{r0}$ and which is positioned on the left side of the dielectric strip 3. Reference numeral 62 in FIG. 6 shows an electric field strength of another air space having a dielectric constant $\epsilon_{r0}$ and which is positioned on the right side of the dielectric strip 3. To effectively reflect the high-frequency wave leaked leftward from the dielectric strip 3 back toward the rightward direction and the step 2*s*, it is preferable that the position where the reflection plate 4 is located and the position where the step 2*s* is formed are such that the electric field strength generated by the high-frequency signal transmitted by the NRD waveguide is relatively high.

The dielectric strip 3 is a dielectric material which is low in loss at high frequencies, such as Teflon, polyethylene, polystyrene, or the like, having a dielectric constant $\epsilon_{r1}$ sufficiently higher than the dielectric constant of air $\epsilon_{r0}$. When the dielectric strip 3 has a height a and width b, if the wavelength of free space is $\lambda$, then the following equations (1) and (2) are effected:

$$\frac{a}{\lambda} \approx 0.45, \tag{1}$$

and $$\frac{\epsilon_{rp} \cdot b}{\lambda} \approx 0.5, \tag{2}$$

where $\epsilon_{rp}$ is the square root of $(\epsilon_r - 1)$

In addition, the terminating portion of the dielectric strip 3 on the upper side in FIG. 1 and FIG. 2 is terminated by a resistive terminator (not shown). However, the present invention is not limited to this, and the terminating portion of the dielectric strip 3 is not necessarily required to be terminated by a resistive terminator.

Further, a dielectric prism 5 for deflecting the direction of radiation of the leakage high-frequency wave toward a direction perpendicular to the longitudinal direction of the dielectric strip 3 is formed to be charged therein so as to be sandwiched at a position which is a predetermined distance away from the formation position of the step 2*s* in the rightward direction thereof and which is leftward of the formation position of the slot antenna 10. The dielectric prism 5 is made of a dielectric material such as Teflon having a dielectric constant $\epsilon_{r2}$. The left-side surface of the dielectric prism 5 provides a plane of incidence which the leakage high-frequency wave is to enter, as will be described in detail later, wherein a plurality of recessed portions are formed so as to be shaped into a sawtooth wave or a triangular wave in the plan view of FIG. 1 so that a zoned portion is formed at a prism angle $\theta_{ds}$. On the other hand, the right-side surface of the dielectric prism 5 is an outgoing plane through which the leakage high-frequency wave having been incident into the dielectric prism 5 goes out, wherein the outgoing plane is provided so as to be parallel to the right and left surfaces of the dielectric strip 3.

When the dielectric strip 3 of the NRD waveguide has an effective dielectric constant $\epsilon_e$, then a prism angle $\theta_{ds}$ and a zoning depth t of the dielectric prism 5 are represented by the following Equations (3) and (4), respectively:

$$\tan(\theta_{ds}) = \frac{\sqrt{\epsilon_e}}{\sqrt{\epsilon_{r2}} - (1 - \sqrt{\epsilon_e})}, \tag{3}$$

and $$t = \frac{\lambda}{\sqrt{\epsilon_{r2}} - 1}. \tag{4}$$

As apparent from the above Equation 3 and Equation 4, when a dielectric material having a relatively large dielectric constant $\epsilon_{r2}$ is used as the material of the dielectric prism 5, the prism angle $\theta_{ds}$ and zoning depth t can be reduced, which is advantageous in the actual manufacturing process.

Also, as shown in FIG. 2 and FIG. 3, the slot antenna 10 is formed on the right side of the dielectric prism 5. The slot antenna 10 comprises a plurality of rectangular slots 11, the longitudinal direction of which is parallel to the longitudinal direction of the dielectric strip 3, and which are formed in the upper grounded electrical conductor plate 1 at intervals of one wavelength of the standing wave. In addition, a reflection plate (not shown) made of a metal plate is sandwiched between right ends of the upper and lower electrical conductor plates 1 and 2, which are located in the right side of the slot antenna 10, so as to oppose the reflection plate 4.

An operation of the plane antenna apparatus using the leakage NRD waveguide of the first preferred embodiment constructed as described above is now described in detail.

Figure 7:
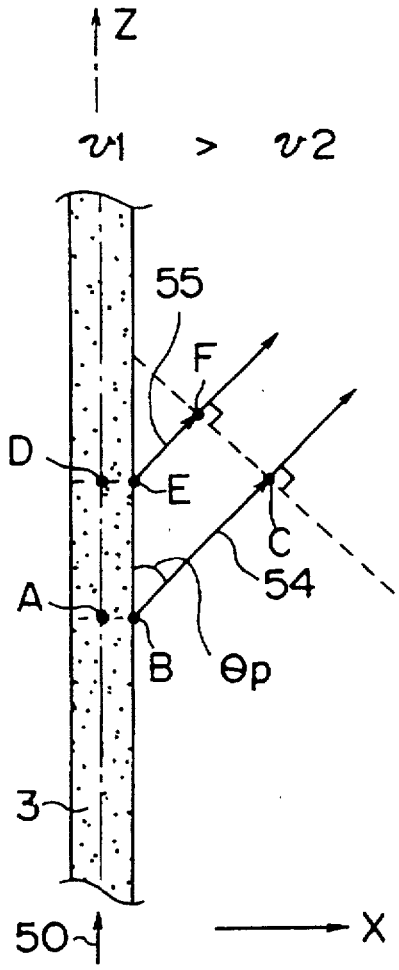
FIG. 7 is a plan view showing electric field strength in proximity to the leakage NRD waveguide with an electrical conductor plate removed, which is provided for explaining a direction in which electromagnetic waves are radiated from the leakage NRD waveguide of the first preferred embodiment.

As shown in FIG. 1 and FIG. 7, when a high-frequency signal is applied to the dielectric strip 3 in the direction of the arrow 50, which is the Z-axis direction, the high-frequency signal propagates through the dielectric strip 3 in the Z-axis direction. Since the dielectric constant $\epsilon_{r1}$, of the dielectric strip 3 is greater than the dielectric constant $\epsilon_{r0}$ of the air layers on both sides of the dielectric strip 3, a phase velocity v1 of the propagating high-frequency wave is higher than a phase velocity v2 of the leakage (i.e., leaked) high-frequency wave. Accordingly, the leakage high-frequency wave propagates leaking rightward and leftward from the dielectric strip 3. For example, with regard to the leakage high-frequency wave propagating rightward, a point F is a location at which the phase at point C of the high-frequency wave that has leaked from point A through point B of the side surface of the dielectric strip 3 and the phase of the high-frequency wave that has been leaked in a direction 55 from point D through point E of the side surface of the dielectric strip 3 are coincident with each other. That is, the leakage high-frequency wave progresses at a radiation angle $\theta_p$ (<90°) with respect to the Z-axis, propagating as a plane wave. On the other hand, the leakage high-frequency wave that has been leaked and radiated leftward from the dielectric strip 3 is reflected by the reflection plate 4, and thereafter is reflected toward the dielectric strip 3, passing the dielectric strip 3 and propagating rightward from the dielectric strip 3.

Then at the step 2*s*, as shown in FIG. 1 and FIG. 3, an electric field is generated between the upper and lower electrical conductor plates 1 and 2 in the vertical direction which is the Y-axis direction, due to the housing structure being vertically asymmetrical at this position. As a result, a leakage high-frequency wave is leaked and radiated, propagating between the upper and lower electrical conductor plates 1 and 2 while holding a radiation angle $\theta_g$ shown in FIG. 1 equal to the radiation angle $\theta_p$. Further, as shown in FIG. 1, the leakage high-frequency wave enters the zoned plane of incidence of the dielectric prism 5 in the direction of an arrow 51 at an angle of incidence θin (<90°), and thereafter is refracted by the plane of incidence, propagating through the dielectric prism 5 in a direction of an arrow 52 which is the X-axis direction perpendicular to the longitudinal direction of the dielectric strip 3, i.e. at an angle θout ($\theta_{in}<\theta_{out}<90°$, $\theta_{ds}+\theta_{out}=90°$) with respect to the plane of incidence. Then, the leakage high-frequency wave goes out in a direction 53 perpendicular to the outgoing surface of the dielectric prism 5, propagating between the upper and lower electrical conductor plates 1 and 2 with a high radiation efficiency in a state of substantially uniform electric field distribution and almost no residual power.

Subsequently, the leakage high-frequency wave of plane wave enters the slot antenna 10 and propagates in the space under the array of the rectangular slots 11, and is reflected by the right-end reflection plate (not shown). Therefore, the leakage high-frequency wave between the upper and lower electrical conductor plates 1 and 2 in the slot antenna 10 results in a standing-wave distribution. At this point, the leakage high-frequency wave excites the array of slots 11 disposed in parallel to the dielectric strip 3. Since the plurality of slots 11 are formed at intervals of one wavelength of the standing wave and positioned so that their magnetic fields are at a maximum, the slots 11 are excited in phase while the longitudinal direction of the slots 11 is also excited in phase. Accordingly, the electromagnetic waves of the leakage high-frequency waves are radiated toward the free space as linearly polarized waves in the upward direction in the plan view of radiation perpendicular to the plane of the electrical conductor plate 1.

In the leakage NRD waveguide constructed as described above, the dielectric strip 3 is not provided with any recessed portions as is formed in the conventional devices, but is provided with only the step 2*s* in the electrical conductor plate 2. As a result, the manufacturing process becomes simple and the manufacturing cost can be reduced. Further, since the dielectric prism 5 is not provided with a plurality of recessed portions, unnecessary reflected waves can be suppressed, so that the frequency characteristic of the input impedance can be improved and also a wider bandwidth operation can be realized. Further, by provision of the dielectric prism 5, the leakage high-frequency wave that has been leaked and radiated can be deflected in the same direction and then can be radiated with high radiation efficiency in a state of substantially uniform electric field distribution and almost no residual power. Still further, by combining the leakage NRD waveguide and the slot antenna 10 together, there can be provided the plane antenna apparatus which operates in a wider bandwidth and with higher efficiency, as compared with the conventional leakage NRD waveguide.

Figure 4:
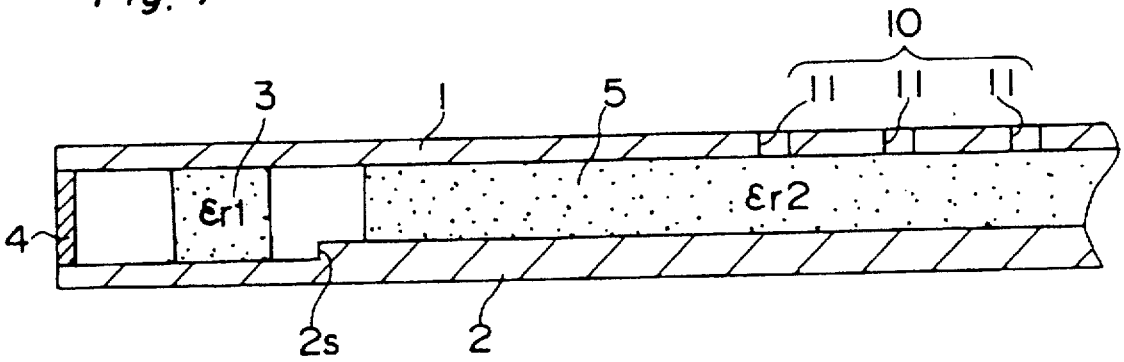
FIG. 4 is a longitudinal sectional view of a plane antenna apparatus using a leakage NRD waveguide, which is a first modification of the first preferred embodiment according to the present invention.

In the above first preferred embodiment, the dielectric prism 5 is located at a position between the step 2*s* and the slot antenna 10 so as to be charged by leaking and radiating high frequency waves. However, the present invention is not limited to this positioning of the dielectric prism 5, and a partial portion of the dielectric prism 5 other than the zoned portion thereof may be formed to be charged by leaking waves up to the position of the slot antenna 10 as shown in FIG. 4. In this case, the dielectric strip 3 has a dielectric constant $\epsilon_{r1}$ and the dielectric prism 5 has a dielectric constant $\epsilon_{r2}$. By this arrangement, the grating lobe in the radiation directivity characteristic of the leakage NRD waveguide can be reduced.

Figure 5:
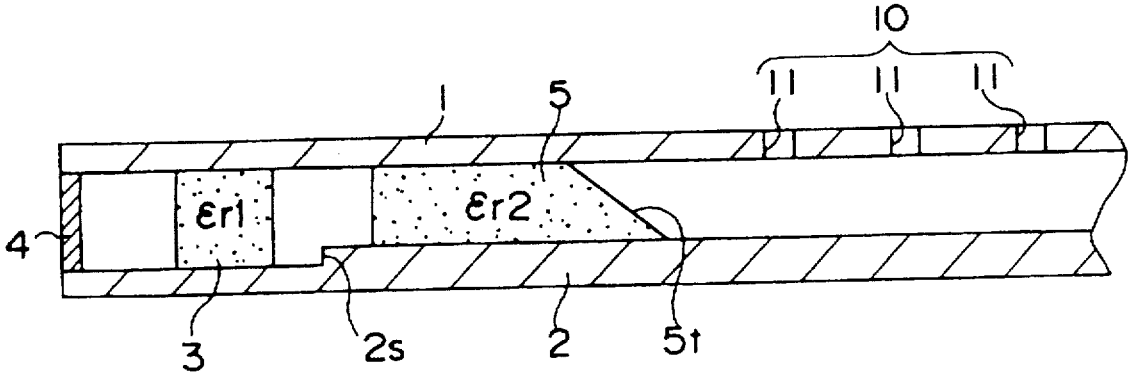
FIG. 5 is a longitudinal sectional view of a plane antenna apparatus using a leakage NRD waveguide, which is a second modification of the first preferred embodiment according to the present invention.

Further, as shown in FIG. 5, a tapered portion 5*t* may be provided on the outgoing surface of the dielectric prism 5 so that the length of the dielectric prism 5 on the electrical conductor plate 2 side in the X-axis direction is longer than that on the electrical conductor plate 1 side. In this case, the dielectric strip 3 has a dielectric constant $\epsilon_{r1}$ and the dielectric prism 5 has a dielectric constant $\epsilon_{r2}$.

Still further, a tapered portion may be provided at the step 2*s* so that the distance between the upper and lower electrical conductor plates 1 and 2 becomes shorter gradually. By this arrangement, the side lobe in the radiation directivity characteristic of the leakage NRD waveguide can be reduced.

Figure 9:
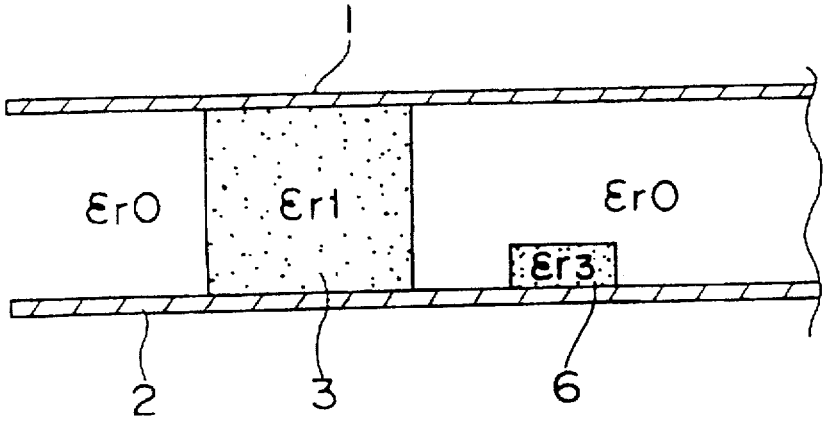
FIG. 9 is a longitudinal sectional view of a leakage NRD waveguide, which is a fourth preferred embodiment according to the present invention.
Figure 10:
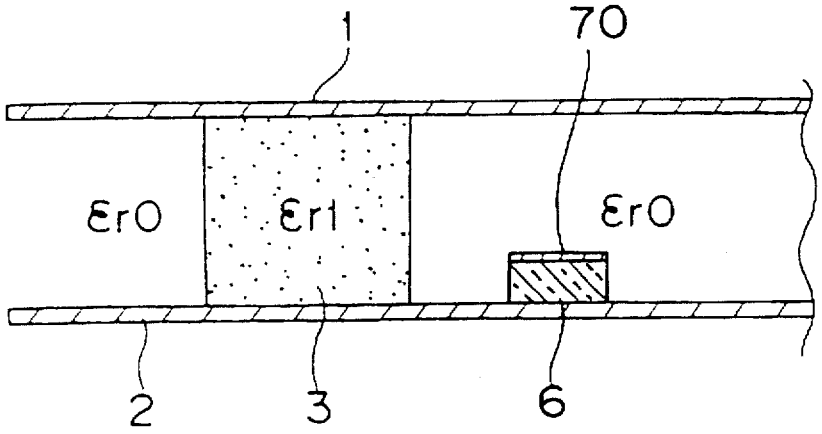
FIG. 10 is a longitudinal sectional view of a leakage NRD waveguide, which is a fifth modification of the first preferred embodiment according to the present invention.
Figure 11:
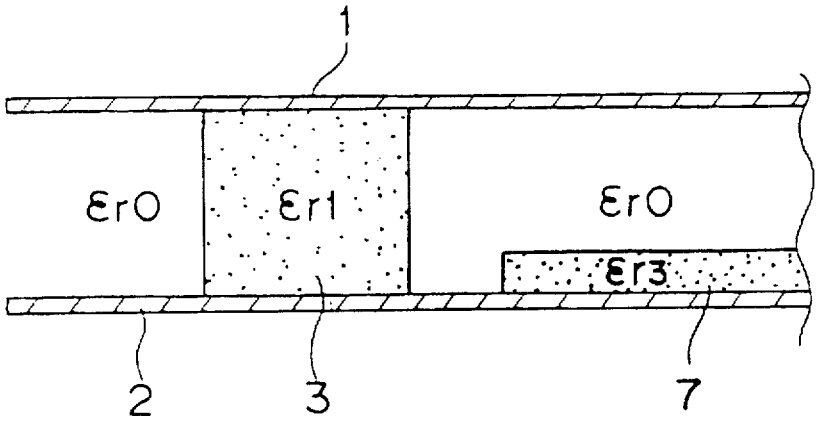
FIG. 11 is a longitudinal sectional view of a leakage NRD waveguide, which is a sixth modification of the first preferred embodiment according to the present invention.
Figure 12:
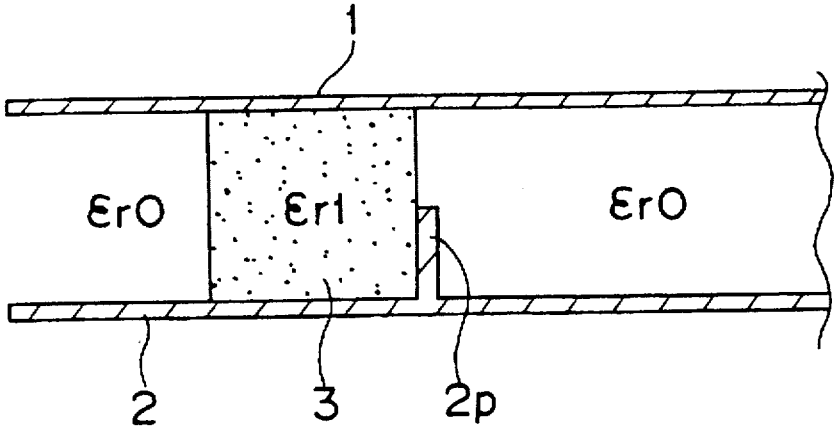
FIG. 12 is a longitudinal sectional view of a leakage NRD waveguide, which is a seventh modification of the first preferred embodiment according to the present invention.
Figure 13:
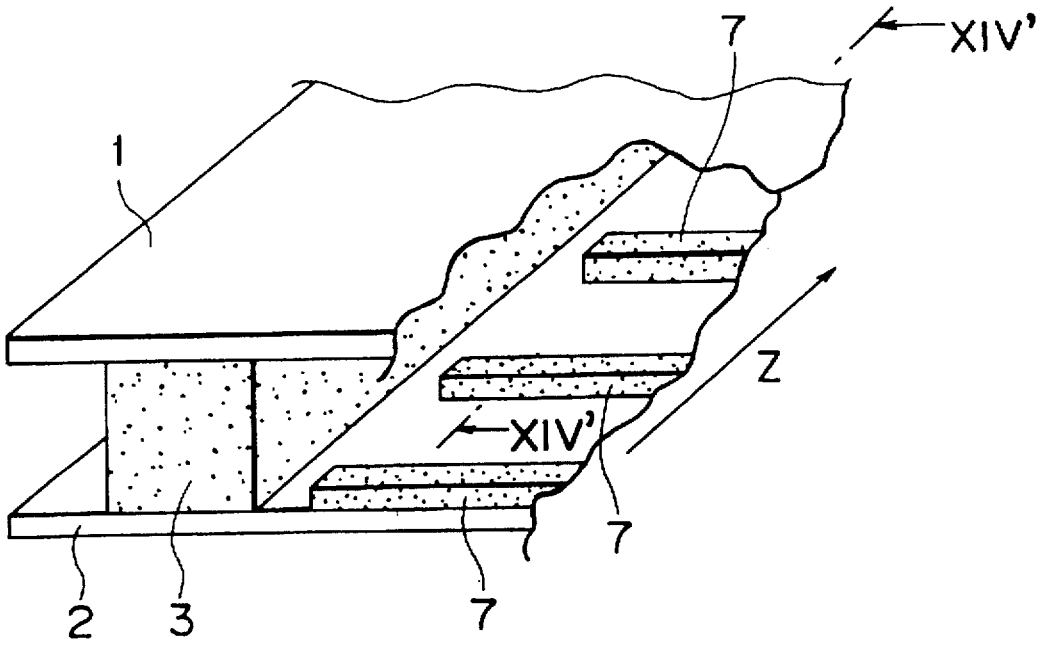
FIG. 13 is a perspective view of a leakage NRD waveguide, which is an eighth modification of the first preferred embodiment according to the present invention.
Figure 14:
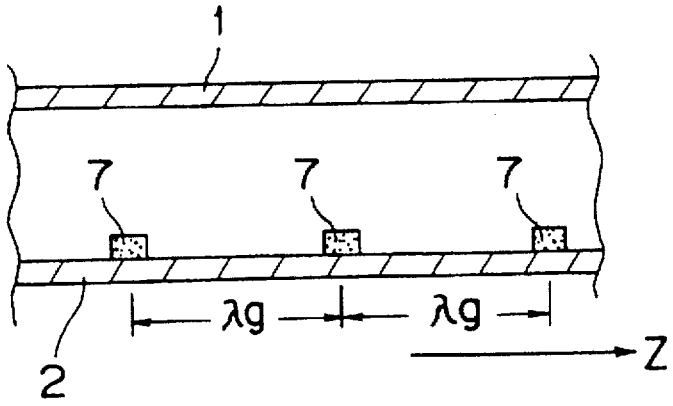
FIG. 14 is a longitudinal sectional view taken along a line XIV—XIV' of FIG. 13.
Figure 15:
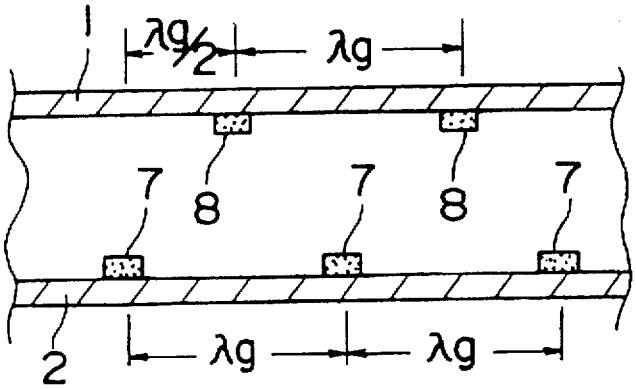
FIG. 15 is a longitudinal sectional view of a leakage NRD waveguide, which is a ninth modification of the first preferred embodiment according to the present invention.

In the above-described preferred embodiments, the leakage NRD waveguide has the step 2*s* formed in the lower electrical conductor plate 2 as a structure for leaking and radiating a leakage high-frequency wave. However, the present invention is not limited to this, but the present invention may be a waveguide housing structure as shown in the following examples (a) through (d):

(a) As shown in FIG. 9, a dielectric strip 6 having a dielectric constant $\epsilon_{r3}$ may be provided on the electrical conductor plate 2 on the right side of the dielectric strip 2, disposed in parallel to the longitudinal direction of the dielectric strip 3 and at a predetermined distance away from the dielectric strip 3;

(b) As shown in FIG. 10, a microstrip line may be provided by forming a strip-shaped dielectric strip 6 on the electrical conductor plate 2 on the right side of the dielectric strip 3 so as to have a longitudinal direction parallel to the dielectric strip 3 and by further forming a strip electrical conductor 70 on the dielectric strip 6;

(c) As shown in FIG. 11, a dielectric slab 7 having a dielectric constant $\epsilon_{r3}$ having a longitudinal direction perpendicular to the dielectric strip 3 may be provided on the electrical conductor plate 2 on the right side of the dielectric strip 3 so as to be a predetermined distance away from the dielectric strip 3. In this case, the leakage NRD waveguide operates in such a manner that a leakage high-frequency wave is radiated by the dielectric slab 7 in a direction tilted with respect to the longitudinal direction of the dielectric strip 3. Further, to radiate and propagate the leakage high-frequency wave more efficiently, a plurality of dielectric slabs 7 may be provided on the electrical conductor plate 2 on the right side of the dielectric strip 3 in a periodic structure at intervals of a propagation wavelength λg (FIG. 14) that to each slab has a to one another, as shown in FIG. 13 and FIG. 14. Still further, a plurality of dielectric strips 8 may be provided on the lower surface of the upper electrical conductor plate 1 in a periodic structure so as to be parallel to the plurality of dielectric slabs 7 and to be spaced from the dielectric slabs 7 each at an interval of λg/2, as well as, spaced from one another at intervals of a propagation wavelength λg, as shown in FIG. 15; and (d) As shown in FIG. 12, a protruding or projecting electrical conductor 2*p* may be provided so as to vertically protrude or project into the inner part of the housing from the electrical conductor plate 2 on the right-side surface of the dielectric strip 3.

<Second Preferred Embodiment>

Figure 16A:
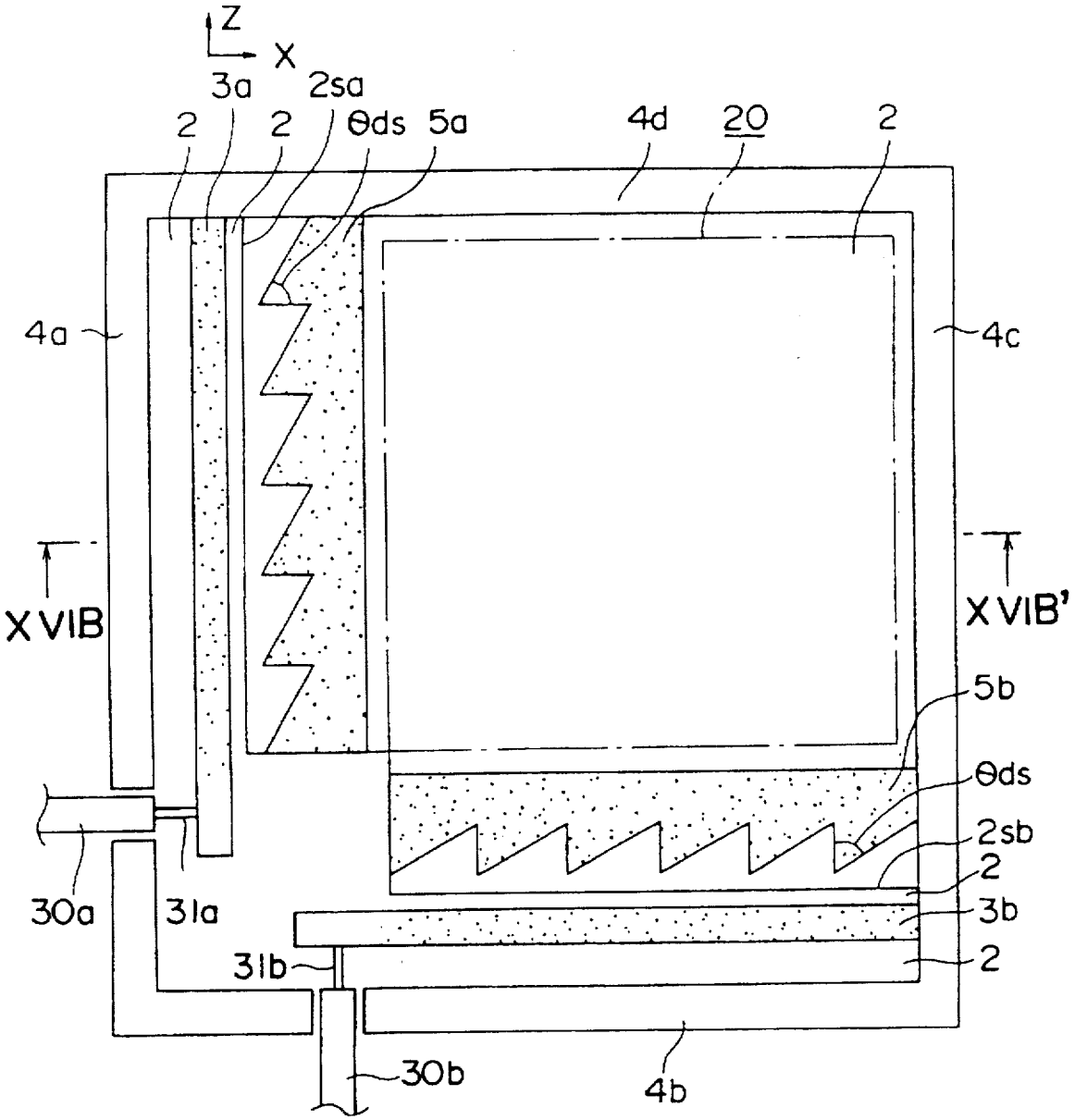
FIG. 16A is a plan view of a plane antenna apparatus using the leakage NRD waveguide, which is a second preferred embodiment according to the present invention, wherein the electrical conductor plate has been removed.
Figure 16B:
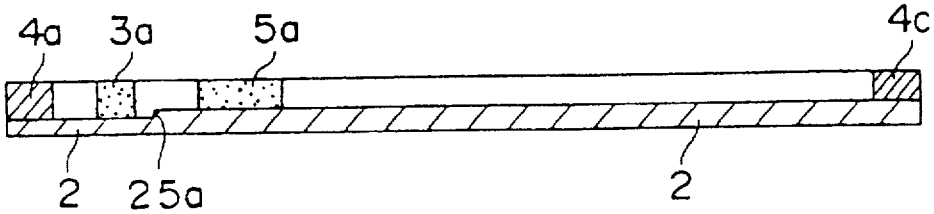
FIG. 16B is a longitudinal sectional view taken along a line XVIB—XVIB' of FIG. 16A.
Figure 17A:
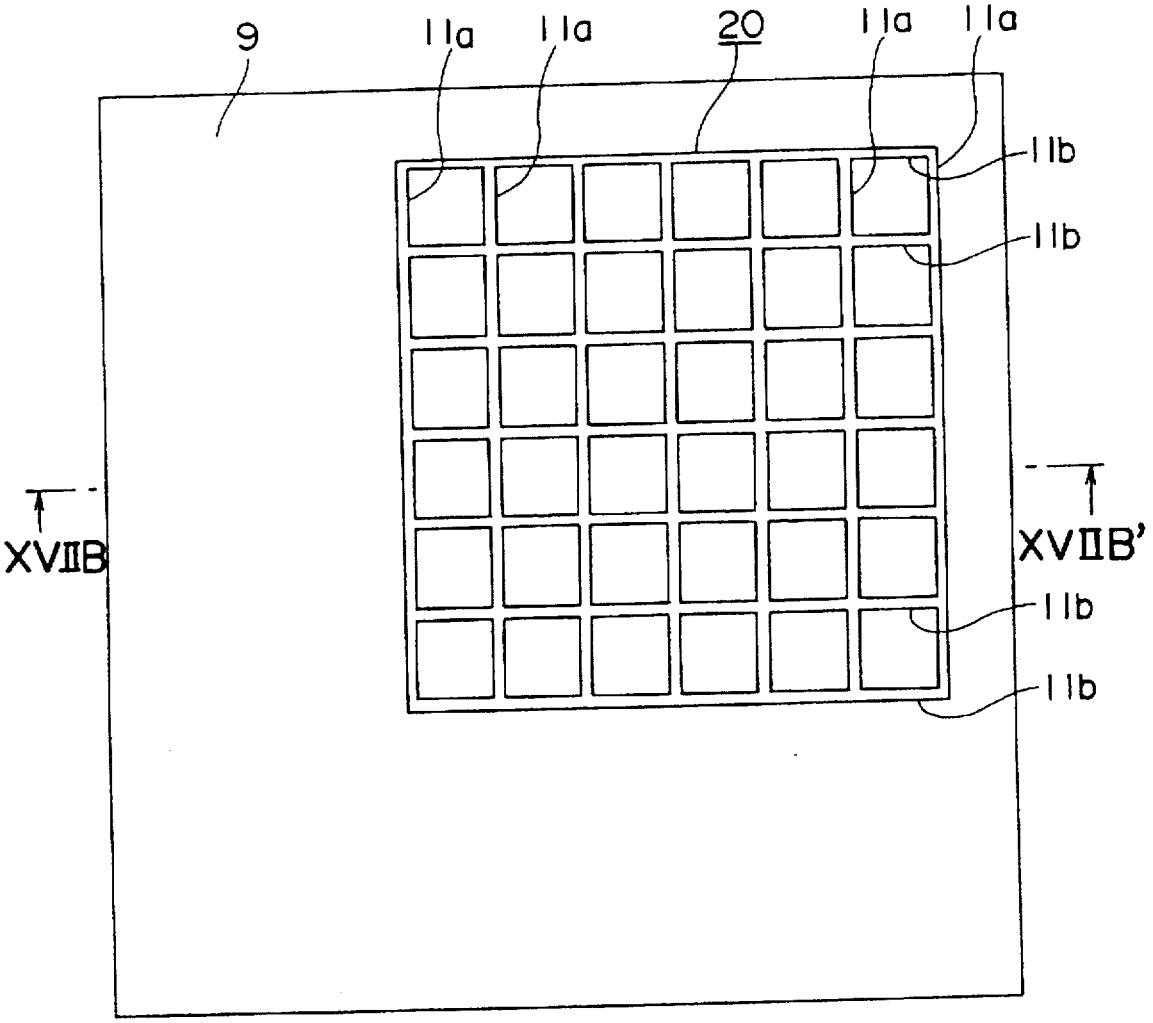
FIG. 17A is a plan view of the plane antenna apparatus using the leakage NRD waveguide of FIGS. 16A and 16B.
Figure 17B:
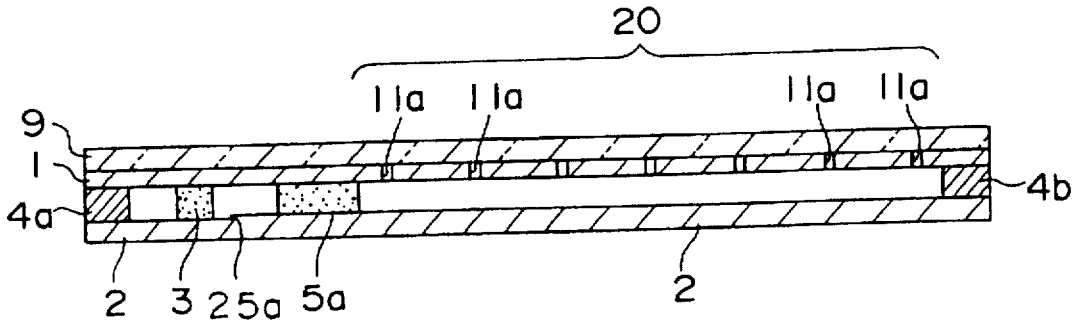
FIG. 17B is a longitudinal sectional view taken along a line XVIIB—XVIIB' of FIG. 17A.

FIG. 16A is a plan view of a plane antenna apparatus using a leakage NRD waveguide which is a second preferred embodiment according to the present invention, in which the electrical conductor plate 1 has been removed, and FIG. 16B is a longitudinal sectional view take along a line XVIB—XVIB'. Further, FIG. 17A is a plan view of a plane antenna apparatus using the leakage NRD waveguide of FIGS. 16A and 16B, and FIG. 17B is a longitudinal sectional view taken along a line XVIIB—XVIIB'.

The features of the plane antenna apparatus of the second preferred embodiment are as follows. Two plane antennas (hereinafter, referred to as plane antenna units) each comprising both of the leakage NRD waveguide and the slot antenna of the first preferred embodiment are arranged integrally so that dielectric strips 3*a* and 3*b* perpendicularly cross each other, wherein a grating slot antenna 20 shown in FIG. 17A, comprising an array of a plurality of rectangular slots 11*a* and an array of a plurality of rectangular slots 11*b* both of which are formed perpendicularly to each other and integrally with the upper electrical conductor plate 1 (see FIG. 17B), is provided as a radiation antenna.

As shown in FIGS. 16A, 16B, 17A and 17B, in one plane antenna unit, between the upper and lower electrical conductor plates 1 and 2 and between a left-end reflection plate 4*a* and a right-end reflection plate 4*c* in the plan view, there are sequentially formed a dielectric strip 3*a*, a step 2*sa*, a dielectric prism 5*a* (having prism angles $\theta_{ds}$), an array of a plurality of rectangular slots 11*a* (FIG. 17A), and the reflection plate 4*c*, in the order from left end to right, in a manner similar to that of the first preferred embodiment. Meanwhile, in another plane antenna unit, between the upper and lower electrical conductor plates 1 and 2 and between a lower-end reflection plate 4*b* and an upper-end reflection plate 4*d* in the plan view, there are sequentially formed a dielectric strip 3*b*, a step 2*sb*, a dielectric prism 5*b* (having prism angles $\theta_{ds}$), an array of a plurality of rectangular slots 11*b*, and the reflection plate 4*b*, in the order from lower end to upward, in a manner similar to that of the first preferred embodiment.

In the grating slot antenna 20, the plurality of slots 11*a* are formed at intervals of the wavelength of standing wave λ so that their longitudinal direction is parallel to the longitudinal direction of the dielectric strip 3*a*. Meanwhile, the plurality of slots 11*b* are formed at intervals of the wavelength of standing wave λ so that their longitudinal direction is parallel to the longitudinal direction of the dielectric strip 3*b*. By this arrangement, the array of the slots 11*a* and the array of the slots 11*b* are grated or forms a grating as shown in FIG. 17A.

On the entire surface of the electrical conductor plate 1, there is further provided a radome 9 shown in FIG. 17A which passes therethrough high frequencies waves and which is made of a resin material such as PC (polycarbonate), PBT (polybutylene terephthalate), FRPP (fiber reinforced polypropylene) or the like. Further, a center electrical conductor 31*a* of a coaxial cable 30*a* is inserted at a lower end of the dielectric strip 3*a*, so that a first high-frequency signal is applied to the dielectric strip 3*a* through the coaxial cable 30*a*. Meanwhile, a center electrical conductor 31*b* of a coaxial cable 30*b* is inserted at a left end of the dielectric strip 3*b*, so that a second high-frequency signal is applied to the dielectric strip 3*b* through the coaxial cable 30*b*.

In the plane antenna apparatus of the second preferred embodiment constructed as described above, when first and second high-frequency signals having a phase difference of 90° therebetween are applied to the dielectric strips 3*a* and 3*b* through the coaxial cables 30*a* and 30*b*, respectively, then, in a manner similar to that of the first preferred embodiment, the first leakage high-frequency wave which has been leaked from the dielectric strip 3*a* and radiated by the step 2*sa* is deflected by the dielectric prism 5*a* (having prism angle $\theta_{ds}$) so as to be transmit in the X-axis direction perpendicular to the longitudinal direction of the dielectric strip 3*a*, entering the grating slot antenna 20 so as to excite the array of the rectangular slots 11*a*. On the other hand, the second leakage high-frequency wave which has been leaked from the dielectric strip 3*b* and radiated by the step 2*sb* is deflected by the dielectric prism 5*b* so as to transmit in the Z-axis direction perpendicular to the longitudinal direction of the dielectric strip 3*b*, entering the grating slot antenna 20 so as to excite the array of the rectangular slots 11*b*. As a result, the high-frequency electromagnetic waves of a linearly polarized wave are radiated from the plane antenna units in a direction perpendicular to the surface of the electrical conductor plate 1. In this case, since the first and second high-frequency signals for effecting the above-described excitation have a phase difference of 90° therebetween, there are projected the high-frequency electromagnetic waves of clockwise or counterclockwise circularly polarized waves, in a manner known to those skilled in the art.

In the above-described second preferred embodiment, it has been arranged that circularly polarized waves are radiated. However, the present invention being not limited to this, it is also possible that two plane antenna units are arranged so that the respective resonance frequencies of the two plane antenna units are different from each other. In this case, two high-frequency signals having respective frequencies substantially equal to the two resonance frequencies thereof may be applied to the grating slot antenna 20 for excitation. In such a case, the plane antenna apparatus serves as a plane antenna apparatus of linearly polarized waves of two frequencies.

Figure 18A:
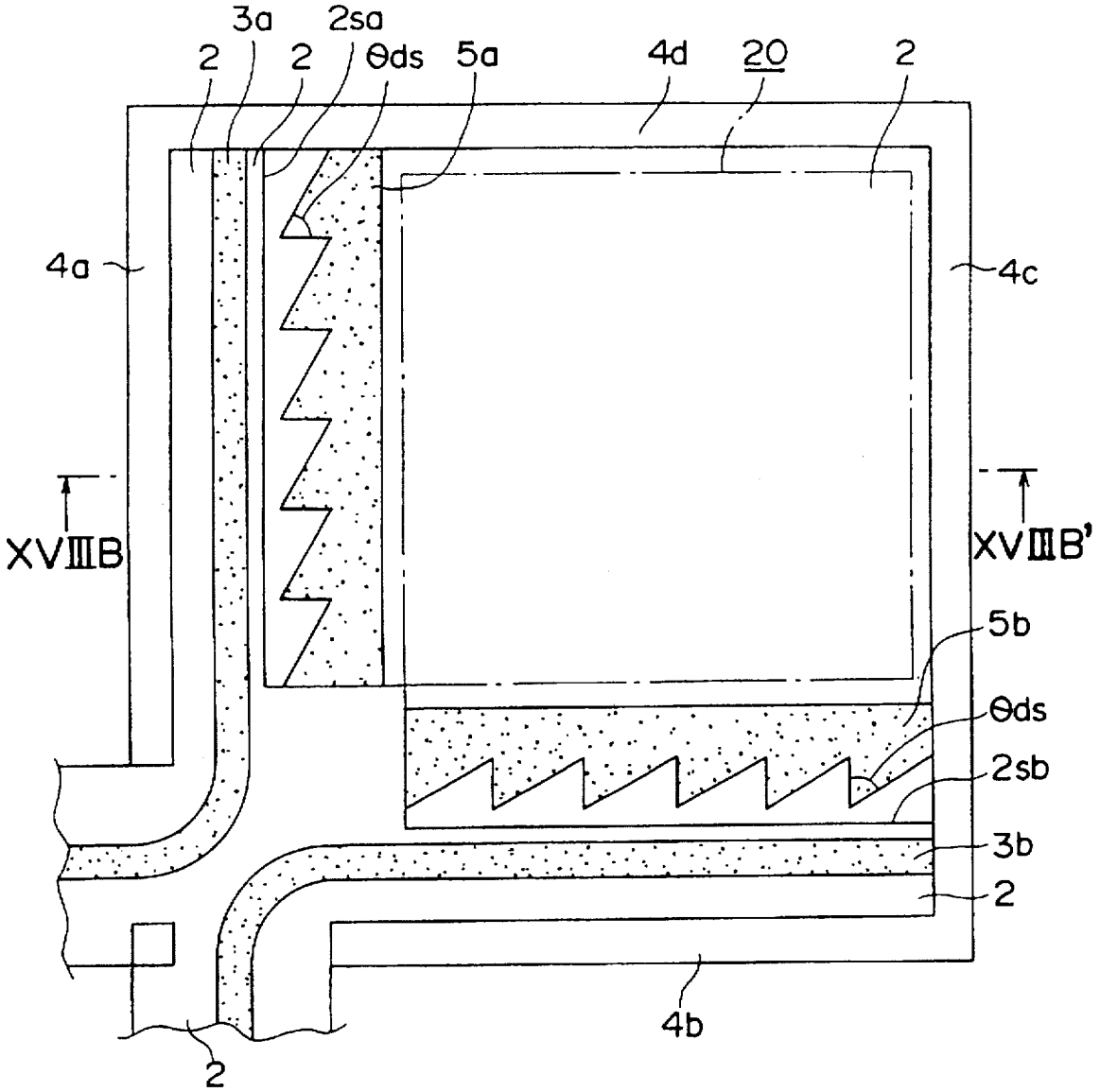
FIG. 18A is a plan view of the plane antenna apparatus using the leakage NRD waveguide which is a modification of the second preferred embodiment, wherein the electrical conductor plate 1 has been removed.
Figure 18B:
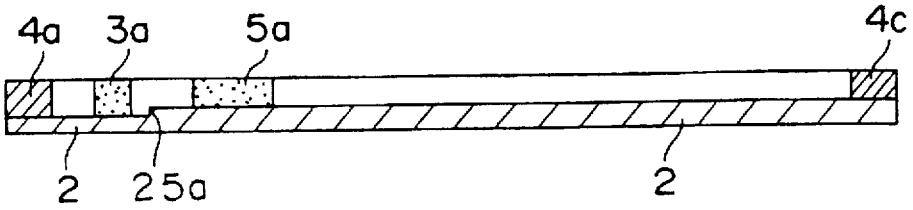
FIG. 18B is a longitudinal sectional view taken along a line XVIIIB—XVIIIB' of FIG. 18A.

FIG. 18A is a plan view of a plane antenna apparatus using a leakage NRD waveguide which is a modification of the second preferred embodiment, in which the electrical conductor plate 1 has been removed. FIG. 18B is a longitudinal sectional view of the plane antenna apparatus taken along a line XVIIIB—XVIIIB'.

The features of the modification of the second preferred embodiment are as follows, as compared with the second preferred embodiment. The lower end of the dielectric strip 3*a* and the left end of the dielectric strip 3*b* extend up onto corresponding other substrates so that electric power is supplied through the dielectric strips 3*a* and 3*b*.

<Third Preferred Embodiments>

Figure 19A:
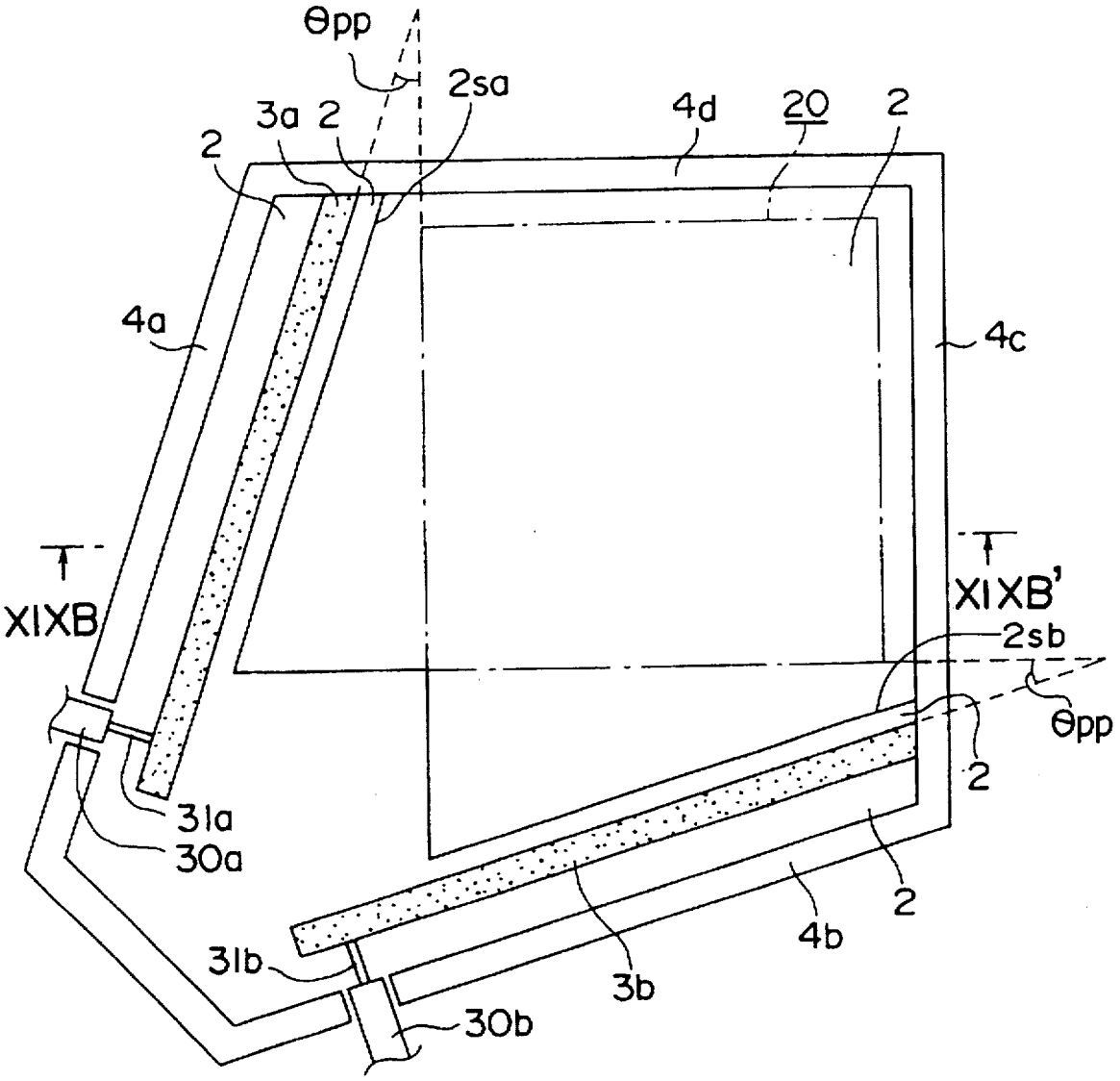
FIG. 19A is a plan view of a plane antenna apparatus using the leakage NRD waveguide which is a third preferred embodiment according to the present invention, wherein the electrical conductor plate 1 has been removed.
Figure 19B:
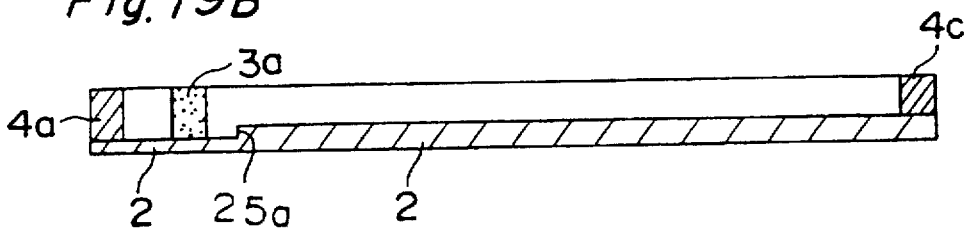
FIG. 19B is a longitudinal sectional view taken along a line XIXB—XIXB' of FIG. 19A.

FIG. 19A is a plan view of a plane antenna apparatus using a leakage NRD waveguide which is a third preferred embodiment according to the present invention, in which the electrical conductor plate 1 has been removed. FIG. 19B is a longitudinal sectional view taken along a line XIXB—XIXB'.

The features of the third preferred embodiment are as follows, as compared with the second preferred embodiment. The dielectric prisms 5*a* and 5*b* are not provided, and then the longitudinal directions of the dielectric strip 3*a* and the step 2*sa* are inclined with respect to the longitudinal direction of the array of the slots 11*a* (FIG. 17A) of the grating slot antenna 20 by an inclination angle θpp, while the longitudinal directions of the dielectric strip 3*b* and the step 2*sb* are inclined with respect to the longitudinal direction of the array of the slots 11*b* (FIG. 17B) of the grating slot antenna 20 by a tilt angle θpp. In this case, the inclination angle θpp is set substantially equal to the radiation angle θp of FIG. 7 and the radiation angle θg of FIG. 1. In addition to this, the longitudinal direction of the dielectric strip 3*a* and the longitudinal direction of the formation position of the step 2*s* a are parallel to each other, while the longitudinal direction of the dielectric strip 3*b* and the longitudinal direction of the formation position of the step 2*sb* are parallel to each other.

By the above arrangement, the first and second leakage high-frequency waves are leaked from the dielectric strips 3*a* and 3*b* and radiated by the steps 2*sa* and 2*sb*, respectively, and then enter the grating slot antenna 20 in the directions perpendicular to the array of the slots 11*a* and the array of the slots 11*b* of the grating slot antenna 20, respectively, resulting in exciting of the arrays of slots in a manner similar to that of the second preferred embodiment. That is, the operation of the third preferred embodiment is substantially the same as the second preferred embodiment, except that deflection by the dielectric prisms 5*a* and 5*b* is not effected.

The third preferred embodiment as described above is provided with two plane antenna units. However, the present invention is not limited to this, and it may also be provided with only one plane antenna unit. Further, in the second and third preferred embodiments, there have been provided two sets of plane antennas, one set of which comprises one leakage NRD waveguide and one plane antenna unit. However, the present invention is not limited to this, it is also allowed that three or more sets of plane antennas are provided.

<Other Preferred Embodiments>

In the above-described preferred embodiments, the electrical conductor plates 1 and 2 have been used. However, the present invention is not limited to this, it may also be arranged that a electrical conductor layer or a electrical conductor film is formed on a dielectric substrate made of a dielectric material having a dielectric constant substantially smaller than the dielectric constant $\epsilon_{r1}$ of the dielectric strips 3, 3*a* and 3*b*, i.e. a printed circuit board may also be used.

In the above-described preferred embodiments, it has been arranged to have a housing structure vertically asymmetrical only at one side of the dielectric strips 3, 3*a* and 3*b*. However, the present invention is not limited to this, it may also be arranged to have a housing structure vertically asymmetrical at both sides of the dielectric strips 3, 3*a* and 3*b*.

In the above-described preferred embodiments, there have been used a slot antenna or a grating slot antenna comprising a plurality of slots 11 disposed parallel to one another. However, the present invention is not limited to this, it is also possible to use a cross-shaped slot antenna, a rectangular slot antenna, or other slot antennas, or other types of plane antennas. Further, it is possible to form slots in the electrical conductor plate 1 and form a microstrip patch antenna thereon with a dielectric layer interposed therebetween.

As described above in detail, according to the preferred embodiments of the present invention, there are provided the following examples:

(a) a leakage dielectric waveguide having a dielectric strip provided within a housing composed of plane-shaped parallel electrical conductors, wherein the housing is arranged to be asymmetrical so that a high-frequency wave that propagates through the dielectric strip is leaked and radiated;

(b) a dielectric waveguide having a dielectric strip provided within a housing composed of plane-shaped parallel electrical conductors and side walls, wherein the housing is arranged to be asymmetrical so that a high-frequency wave that propagates through the dielectric strip is leaked and radiated; and (c) a dielectric waveguide having a dielectric strip sandwiched between upper and lower parallel electrical conductors, wherein a vertically asymmetrical housing for leaking and radiating a high-frequency wave that propagates through the dielectric strip is provided on both sides or one side of the dielectric strip.

Accordingly, the dielectric strip 3 is not provided with recessed portions unlike the conventional one, but is provided with only an asymmetrical housing. As a result, the manufacturing process becomes simple and the manufacturing cost can be reduced. Besides, since the dielectric strip is not provided with a plurality of recessed portions, unnecessary waves can be suppressed, so that frequency characteristic of input impedance can be improved and wider-bandwidth operation can be realized.

Further, according to the preferred embodiments of the present invention, there is provided a leakage dielectric waveguide further comprising deflection means for deflecting the direction of radiation of a leaked and radiated high-frequency wave toward a predetermined direction, wherein the housing includes deflection means for deflecting the direction of radiation of a leaked and radiated high-frequency wave toward a predetermined direction or wherein the dielectric strip and the housing are arranged so that the leaked and radiated high-frequency wave is radiated toward a predetermined direction. With this arrangement, the radiated high-frequency wave can be deflected toward the same direction so as to be radiated with high radiation efficiency in a state of a substantially uniform electric field distribution and almost no residual power.

Still further, according to the present preferred embodiment of present invention, there are provided plane antennas in which the above-mentioned leakage dielectric waveguide is combined with means for radiating a leaked and radiated high-frequency wave into free space. In this arrangement, a plane antenna which operates in a wider bandwidth and with higher efficiency can be implemented, compared with the conventional plane antenna.

The leakage dielectric waveguides and the plane antennas are described as devices for transmitting radio waves in the specification. However, since the leakage dielectric waveguides and the plane antennas are reversible devices, they can be provided for receiving radio waves. That is, the leakage dielectric waveguides for receiving radio waves and the plane antenna for receiving radio waves are included in the scope of the invention disclosed in the present application.

Although the present invention has been fully described in connection with the preferred embodiments thereof with reference to the accompanying drawings, it is to be noted that various changes and modifications are apparent to those skilled in the art. Such changes and modifications are to be understood as included within the scope of the present invention as defined by the appended claims unless they depart therefrom.

What is claimed is:

1. A leakage dielectric waveguide comprising:

first and second electrical conductors arranged substantially parallel to each other and defining a space therebetween;

a dielectric strip located in said space between the electrical conductors for propagating an inputted high-frequency wave between said first and second electrical conductors in a propagating direction which is substantially parallel to a longitudinal direction of said dielectric strip; and an elongate step provided in said space at an inner surface of said second electrical conductor for causing a portion of said high-frequency wave to be leaked from said dielectric strip into said space and to radiate in said space in a direction not parallel to said longitudinal direction of the dielectric strip.

2. A leakage dielectric waveguide comprising:

first and second electrical conductors arranged substantially parallel to each other and defining a space therebetween;

a first dielectric strip located in said space between said electrical conductors for propagating an inputted high-frequency wave between said first and second electrical conductors in a propagating direction which is substantially parallel to a longitudinal direction of said first dielectric strip; and a second dielectric strip located in said space for causing a portion of said high-frequency wave to be leaked from said dielectric strip into said space and to radiate in said space in a direction not parallel to said longitudinal direction of said first dielectric strip, said second dielectric strip being coupled to an inner surface of said second electrical conductor in such a position that said second dielectric strip is separate from said first dielectric strip and a longitudinal direction of said second dielectric strip is substantially parallel to said longitudinal direction of said first dielectric strip.

3. A leakage dielectric waveguide comprising:

first and second electrical conductors arranged substantially parallel to each other and defining a space therebetween;

a dielectric strip located in said space between said electrical conductors for propagating an inputted high-frequency wave between said first and second electrical conductors in a propagating direction which is substantially parallel to a longitudinal direction of said dielectric strip; and a microstrip line located in said space for causing a portion of said high-frequency wave to be leaked from said dielectric strip into said space and to radiate in said space in a direction not parallel to said longitudinal direction of said dielectric strip, said microstrip line being coupled to an inner surface of said second electrical conductor in a position where said microstrip line is separate from said dielectric strip and a longitudinal direction of said microstrip line is substantially parallel to said longitudinal direction of said dielectric strip.

4. A leakage dielectric waveguide comprising:

first and second electrical conductors arranged substantially parallel to each other and defining a space therebetween;

a dielectric strip located in said space between said electrical conductors for propagating an inputted high-frequency wave between said first and second electrical conductors in a propagating direction substantially parallel to a longitudinal direction of said dielectric strip; and a third electrical conductor located in said space for causing a portion of said high-frequency wave to be leaked from said dielectric strip into said space and to radiate in said space in a direction not parallel to said longitudinal direction of said dielectric strip, said third electrical conductor being coupled to an inner surface of said second electrical conductor so as to project toward said first electrical conductor in a direction substantially perpendicular to said inner surface of said second electrical conductor.

5. A leakage dielectric waveguide comprising:

first and second electrical conductors arranged substantially parallel to each other and defining a space therebetween;

a dielectric strip located in said space between said electrical conductors for propagating an inputted high-frequency wave between said first and second electrical conductors in a propagating direction which is substantially parallel to a longitudinal direction of said dielectric strip; and a dielectric slab located in said space for causing a portion of said high-frequency wave to be leaked from said dielectric strip into said space and to radiate in said space in a direction not parallel to said longitudinal direction of said dielectric strip, said dielectric slab being coupled to an inner surface of said second electrical conductor at a position where said dielectric slab is separate from said dielectric strip and a longitudinal direction of said dielectric slab is substantially perpendicular to said longitudinal direction of said dielectric strip.

6. A leakage dielectric waveguide comprising:

first and second electrical conductors arranged substantially parallel to each other and defining a space therebetween;

a dielectric strip located in said space between said electrical conductors for propagating an inputted high-frequency wave between said first and second electrical conductors in a propagating direction which is substantially parallel to a longitudinal direction of said dielectric strip; and a plurality of dielectric slabs located in said space for causing a portion of said high-frequency wave to be leaked from said dielectric strip into said space and to radiate in said space in a direction not parallel to said longitudinal direction of said dielectric strip, said dielectric slabs being provided at an inner surface of said second electrical conductor in such positions that said plurality of dielectric slabs are substantially parallel to each other at intervals of a propagation wavelength of said high-frequency wave, are separate from said dielectric strip and each one of the plurality of dielectric slabs a longitudinal direction which is substantially perpendicular to said longitudinal direction of said dielectric strip.

7. A leakage dielectric waveguide comprising:

first and second electrical conductors arranged substantially parallel to each other and defining a space therebetween;

a dielectric strip located in said space between said electrical conductors for propagating an inputted high-frequency wave between said first and second electrical conductors in a propagating direction which is substantially parallel to a longitudinal direction of said dielectric strip; and a plurality of first dielectric slabs and a plurality of second dielectric slabs for causing a portion of said high-frequency wave to be leaked from said dielectric strip into said space and to radiate in said space in a direction not parallel to said longitudinal direction of said dielectric strip, wherein said plurality of first dielectric slabs are disposed substantially parallel to each other at intervals of a propagation wavelength of said high-frequency wave, and being coupled to an inner surface of said second electrical conductor in such positions that said plurality of first dielectric slabs are separate from said dielectric strip and so that a longitudinal direction of each of said plurality of first dielectric slabs is substantially perpendicular to said longitudinal direction of said dielectric strip, and wherein said plurality of second dielectric slabs are disposed substantially parallel to each other at intervals of said propagation wavelength of said high-frequency wave, the positions of said second plurality of dielectric slabs being shifted relative to said positions of said first plurality of dielectric slabs by one half of the propagation wavelength of said high-frequency wave in a direction which runs parallel to said longitudinal direction of said dielectric strip, said plurality of said second dielectric slabs being coupled to an inner surface of said first electrical conductor opposing an inner surface of said second electrical conductor, so as to be separate from said dielectric strip and so that a longitudinal direction of said plurality of second dielectric slabs is substantially perpendicular to the longitudinal direction of said dielectric strip.

8. The leakage dielectric waveguide as claimed in any one of claims 1 to 7, further comprising a side wall of an electrical conductive material, for connecting an end of said first electrical conductor with an end of the second electrical conductor opposing said end of the first electrical conductor, and side wall being provided on a side of said dielectric strip.

9. The leakage dielectric waveguide as claimed in any one of claims 1 to 7, further comprising deflection means for deflecting a direction of radiation of said high-frequency wave having been leaked and radiated, toward a predetermined deflection direction, said deflection means being provided at a position on a side of said dielectric strip.

10. The leakage dielectric waveguide as claimed in claim 9, wherein the deflection means comprises a dielectric prism.

11. A plane antenna apparatus comprising:

first and second electrical conductors arranged substantially parallel to each other and defining a closed space therebetween;

a first dielectric strip located in said closed space between said electrical conductors for propagating an inputted first high-frequency wave between said first and second electrical conductors in a propagating direction which is substantially parallel to a longitudinal direction of said first dielectric strip;

a first elongate step located in said closed space for causing a portion of said first high-frequency wave to be leaked from said first dielectric strip into said closed space and to radiate in said closed space in a direction not parallel to the longitudinal direction of said first dielectric strip, said first elongate step being provided on an inner surface of said second electrical conductor;

a first deflector deflecting said leaked high-frequency wave toward a first deflection direction;

a second dielectric strip located in said closed space between said electrical conductors for propagating an inputted second high-frequency wave between said first and second electrical conductors in a propagating direction substantially parallel to a longitudinal direction of said second dielectric strip;

a second elongate step located in said closed space for causing a portion of said second high-frequency wave to be leaked from said second dielectric strip into said closed space and to radiate in said closed space in a direction not parallel to said longitudinal direction of said second dielectric strip, said second elongate step being provided at an inner surface of said second electrical conductor;

a second deflector deflecting said leaked second high-frequency wave toward a second deflection direction which is substantially perpendicular to said first deflecting direction; and a grating slot antenna for projecting a high frequency wave including said leaked first and second high-frequency waves toward free space, said grating slot antenna comprising a plurality of first elongate slots arranged substantially parallel to each other, and a plurality of second elongate slots arranged substantially parallel to each other and respectively substantially perpendicular to said plurality of first elongate slots, said grating slot antenna being provided between said first deflector and said second deflector so that said plurality of first elongate slots are substantially perpendicular to said first deflection direction, and said plurality of second elongate slots are substantially perpendicular to said second deflection direction.

12. A plane antenna apparatus comprising:

first and second electrical conductors arranged substantially parallel to each other and defining a closed space therebetween;

a first dielectric strip located in said closed space between said electrical conductors for propagating an inputted first high-frequency wave between said first and second electrical conductors in a propagating direction which is substantially parallel to a longitudinal direction of said first dielectric strip;

a first elongate step located in said closed space for causing a portion of said first high-frequency wave to be leaked from said first dielectric strip into said closed space and to radiate in said closed space in a direction not parallel to the longitudinal direction of said first dielectric strip, said first elongate step being provided at an inner surface of said second electrical conductor;

a second dielectric strip located in said space between said electrical conductors for propagating an inputted second high-frequency wave between said first and second electrical conductors in a propagating direction which is substantially parallel to a longitudinal direction of said second dielectric strip;

a second elongate step located in said space for causing a portion of said second high-frequency wave to be leaked from said second dielectric strip into said closed space and to radiate in said closed space in a direction not parallel to a longitudinal direction of said second dielectric strip and substantially perpendicular to said direction in which said leaked first high-frequency wave is propagated . said second elongate step being provided at an inner surface of said second electrical conductor; and a grating slot antenna for projecting a high-frequency wave including said first and second leaked high-frequency waves toward a free space, said grating slot antenna comprising a plurality of first elongate slots arranged substantially parallel to each other, and a plurality of second elongate slots arranged substantially parallel to each other and respectively substantially perpendicular to said plurality of first elongate slots, said grating slot antenna being provided between said first elongate step and said second elongate step so that said plurality of first elongate slots are substantially perpendicular to said direction in which said leaked first high-frequency wave is propagated, and said plurality of second elongate slots are substantially perpendicular to said direction in which said leaked second high-frequency wave is propagated.

* * * * *